US010478850B2

(12) United States Patent
Schwarz et al.

(10) Patent No.: US 10,478,850 B2
(45) Date of Patent: Nov. 19, 2019

(54) POWDER CUP SPRAY GUN AND SPRAY-COATING DEVICE COMPRISING A POWDER CUP SPRAY GUN

(71) Applicant: J. WAGNER AG, Altstatten (CH)

(72) Inventors: Thomas Schwarz, St. Gallen (CH); Rene Schmid, Hinterforst (CH); Gilbert Lutz, Kriessern (CH); Karsten Juterbock, Wangen (DE); Pierre Plascar, Goppingen (DE)

(73) Assignee: Wagner International AG, Altstatten (CH)

( * ) Notice: Subject to any disclaimer, the term of this patent is extended or adjusted under 35 U.S.C. 154(b) by 210 days.

(21) Appl. No.: 13/858,957

(22) Filed: Apr. 9, 2013

(65) Prior Publication Data

US 2013/0270365 A1 Oct. 17, 2013

(30) Foreign Application Priority Data

Apr. 13, 2012 (EP) ..... 12405036

(51) Int. Cl.
*B05C 11/10* (2006.01)
*B05B 5/03* (2006.01)
(Continued)

(52) U.S. Cl.
CPC ..... *B05C 11/10* (2013.01); *B05B 5/032* (2013.01); *B05B 5/1683* (2013.01);
(Continued)

(58) Field of Classification Search
CPC ..... B05B 5/032; B05B 5/1683; B05B 5/1691; B05B 7/1413; B05B 7/2408; B05B 7/2478; B05B 7/0869; B05B 7/0815; B05C 11/10
(Continued)

(56) References Cited

U.S. PATENT DOCUMENTS 2,895,686 A * 7/1959 Peeps ..... B05B 7/0815 239/412
3,590,318 A * 6/1971 Probst et al. ..... 361/227
(Continued)

FOREIGN PATENT DOCUMENTS

DE 25 14 160 A1 9/1976
DE 89 05 926 7/1989
JP 6-320101 A 11/1994

OTHER PUBLICATIONS

Wagner Industrial Solutions, Corona und Tribo Pistolen, Dec. 2011, available at http://www.plasto.bg/uf//BO_C4_Pistolen_Hand_Automatik_web.pdf (Year: 2011).*
(Continued)

*Primary Examiner* — Viet Le
*Assistant Examiner* — Christopher R Dandridge
(74) *Attorney, Agent, or Firm* — Renner, Otto, Boisselle & Sklar, LLP

(57) ABSTRACT

At the rear end, the powder cup spray gun has an injector, a powder cup and a receptacle for the powder cup. The powder inlet of the injector is connected to the receptacle. The powder cup and the receptacle are designed in such a way that the powder cup can be fitted into the receptacle. In addition, a grip with a connection for conveying air, a connection for atomising air, and a connection for metering air is provided. The connection for the conveying air and the connection for the metering air are connected to the injector via lines running in the grip.

10 Claims, 7 Drawing Sheets

(51) Int. Cl.
*B05B 5/16* (2006.01)
*B05B 7/14* (2006.01)
*B05B 7/24* (2006.01)

(52) U.S. Cl.
CPC ..... *B05B 5/1691* (2013.01); *B05B 7/1413* (2013.01); *B05B 7/2408* (2013.01); *B05B 7/2478* (2013.01)

(58) Field of Classification Search
USPC ..... 239/311, 318, 325, 345
See application file for complete search history.

(56) References Cited

U.S. PATENT DOCUMENTS 3,592,363 A * 7/1971 Stout et al. ..... 406/94
4,005,825 A * 2/1977 Schowiak ..... B05B 7/32 239/413
4,088,268 A * 5/1978 Vohringer ..... B05B 5/032 239/143
5,850,976 A * 12/1998 Robidoux ..... 239/698
6,136,379 A * 10/2000 Scarpa et al. ..... 427/422
6,322,000 B1 * 11/2001 Scarpa et al. ..... 239/112
6,375,093 B1 * 4/2002 Fulkerson et al. ..... 239/112
6,892,963 B1 * 5/2005 Scarpa et al. ..... 239/424.5
2005/0211800 A1 * 9/2005 Scarpa et al. ..... 239/423
2008/0041979 A1 * 2/2008 Gardega ..... 239/549

OTHER PUBLICATIONS

European Search Report for corresponding European Application No. EP 12 405 036.0 dated Sep. 19, 2012.
Instruction Manual, "Tribo Becherpistole PEM-TG3", Wagner, Apr. 2006, No. 0351716.
Service Manual, "Hand- und Automatikpistolen", Wagner, Jun. 2006 edition, No. 0351883, p. 121.
Instruction Manual, "Pulver Becherpistole PEM-CG4-HiCoat", Wagner, Feb. 2007 edition, No. 0390821.

* cited by examiner

POWDER CUP SPRAY GUN AND SPRAY-COATING DEVICE COMPRISING A POWDER CUP SPRAY GUN

TECHNICAL FIELD

The invention relates to a powder cup spray gun and to a spray-coating device comprising a powder cup spray gun, which are suitable for spraying coating powder.

For the powder coating of individual parts and very small volumes as well as for laboratory and development purposes, it is expedient to use a handy, flexible and yet powerful piece of equipment. The industry has developed powder cup guns for these applications. In contrast to the powder spray guns used for batch coating and job coating, with these powder cup spray guns the powder storage container is located directly on the spray gun. The powder storage container, which will also be referred to hereinafter as a powder cup or cup for short, has a relatively small capacity. When processing minimal and medium powder volumes, the user can save powder because the powder does not have to be transported to the spray gun via a powder tube from a remote, large powder storage container. The user also does not have to clean the powder tube in the event of a colour change. The small powder cup can also be cleaned much more easily than the large storage container.

BACKGROUND

A cup gun for the above-mentioned uses is known from the instruction manual "Tribo Becherpistole PEM-TG3" as of April 2006, no. 0351716, which is published on the Internet as prior art and is distributed by Wagner GmbH under product no. 0351036. FIG. 1 is taken from the instruction manual and shows a three-dimensional view of the cup gun D. The cup gun D is a manually actuatable powder spray gun with a powder storage container H, which is screwed from above onto the gun D in the rear region. The cup gun D has a screw thread J for this purpose.

A similar cup gun operating with triboelectric charging is known from the service manual "Hand- and Automatikpistolen" June 2006 edition, no. 0351883, page 121 et seq which is likewise published on the Internet as prior art.

Lastly, a powder cup gun operating with corona charging (high voltage) is known from the instruction manual "Pulver Becherpistole PEM-CG4-HiCoat", February 2007 edition, no. 0390821.

These cup guns have the common feature that they have an electrical connection G and a supply connection F for compressed air at the lower end of the hand grip. The electrical connection G is connected to a control unit via an electrical cable, and the supply connection F is connected to a control unit via a compressed air tube. The compressed air supply to the cup gun can be adjusted with the aid of the control unit. These cup guns have the disadvantage however that a colour change cannot be implemented quickly enough. The user has to first carefully unscrew the storage cup from the gun. To this end, he holds the gun with one hand and takes hold of the cup with the other hand and starts to unscrew it. He will generally grasp the cup a number of times in order to be able to unscrew it completely. However, it is awkward to grasp around the cup, in particular if there is still powder in the storage cup, because there is then a risk that the powder will be spilled or will trickle out from the outlet opening of the powder cup.

With the above-described powder cup guns, the compressed air supplied to the gun via the supply connection is divided into a conveying air, a tribo air, (in the case of tribo guns) or an atomising air (in the case of corona guns), a metering air and an air for fluidising the powder. To this end, a manually adjustable valve for the conveying air, a manually adjustable valve for the metering air, a manually adjustable valve for the atomising air or tribo air, and a manually adjustable valve for the fluidising air are located to the rear on the powder cup gun. All valves are connected on the input side to the supply connection. If a valve is then adjusted, it is not possible to ensure that this has no effect on the other airflows. The actual magnitude of the four air pressures is unknown to the user. The four valve settings give only rather inaccurate information regarding said air pressures. This in turn means that it is not easily possible to make recommendations as to how the individual air pressures are to be set in other powder spray guns, in particular in powder spray guns used in batch production. The results achieved are thus only reproducible to a limited extent, and the compressed air settings are not easily transferrable to other spray guns. This is desirable however, inter alia with the development of coating powder.

DISCLOSURE OF THE INVENTION

An object of the invention is to specify a powder cup spray gun with which the colour change can be implemented quickly and smoothly.

The object is achieved by a powder cup spray gun having the features described herein.

The powder cup spray gun according to an embodiment of the invention has an injector with a powder inlet, a powder cup, and a receptacle for the powder cup. The powder inlet of the injector is connected to the receptacle. The powder cup and the receptacle are designed in such a way that the powder cup can be fitted into the receptacle. In addition, a grip having a connection for conveying air, a connection for atomising air, and a connection for metering air is provided. The connection for the conveying air and the connection for the metering air are connected to the injector via lines running in the grip.

Advantageous developments of the invention will emerge from the features described herein.

With the powder cup spray gun according to an embodiment of the invention, a gun housing can thus be provided, which is designed in such a way that the injector can be screwed on from the outside. The injector is thus quickly and easily accessible and can be unscrewed in a few simple steps. The user can then service and clean the injector.

In one embodiment of the powder cup spray gun according to the invention, a ring seal is provided in the receptacle for the powder cup. A secure and reliably sealing connection between the receptacle and the powder cup is thus achieved.

In a further embodiment of the powder cup spray gun according to the invention, a further ring seal is provided in the receptacle for the powder cup. The connection between the receptacle and the powder cup is thus sealed yet more securely and reliably.

In another embodiment of the powder cup spray gun according to the invention, a powder line and a metering air duct are provided, wherein the metering air duct discharges annularly into the powder line.

The injector of the powder cup spray gun according to the invention may have a driving nozzle and a collector nozzle, wherein the driving nozzle has a driving nozzle duct and the collector nozzle has a mixing tube portion. The ratio between the diameter of the driving nozzle duct and the inner diameter of the mixing tube portion is preferably in the range between 1.9 and 2.5.

The powder cup used for the above-described powder cup spray gun may have a side wall, which is funnel-shaped. In addition, a powder outlet, which is tubular, may be provided with the powder cup. The powder is thus drawn continuously into the injector without additional measures. Fluidisation with fluidising air is no longer necessary.

In another embodiment, the powder cup has a lid with a detachable cap. The cap is designed in such a way that it is suitable for closing the powder outlet.

In addition, a spray-coating device comprising the above-described powder cup spray gun and a control unit are proposed. The control unit is designed and operable in such a way that the conveying air, the atomising air and the metering air can be controlled thereby. In addition, compressed air tubes are provided, with which the control unit is connected to the connection for the conveying air, to the connection for the metering air, and to the connection for the atomising air of the powder cup spray gun. An extraordinarily high and permanently constant quality of the powder spray jet is advantageously achieved by the powder spray gun according to the invention in conjunction with the control apparatus.

BRIEF DESCRIPTION OF THE DRAWINGS

The invention will be further explained hereinafter with a plurality of exemplary embodiments on the basis of 9 figures.

EMBODIMENTS OF THE INVENTION

Figure 1:
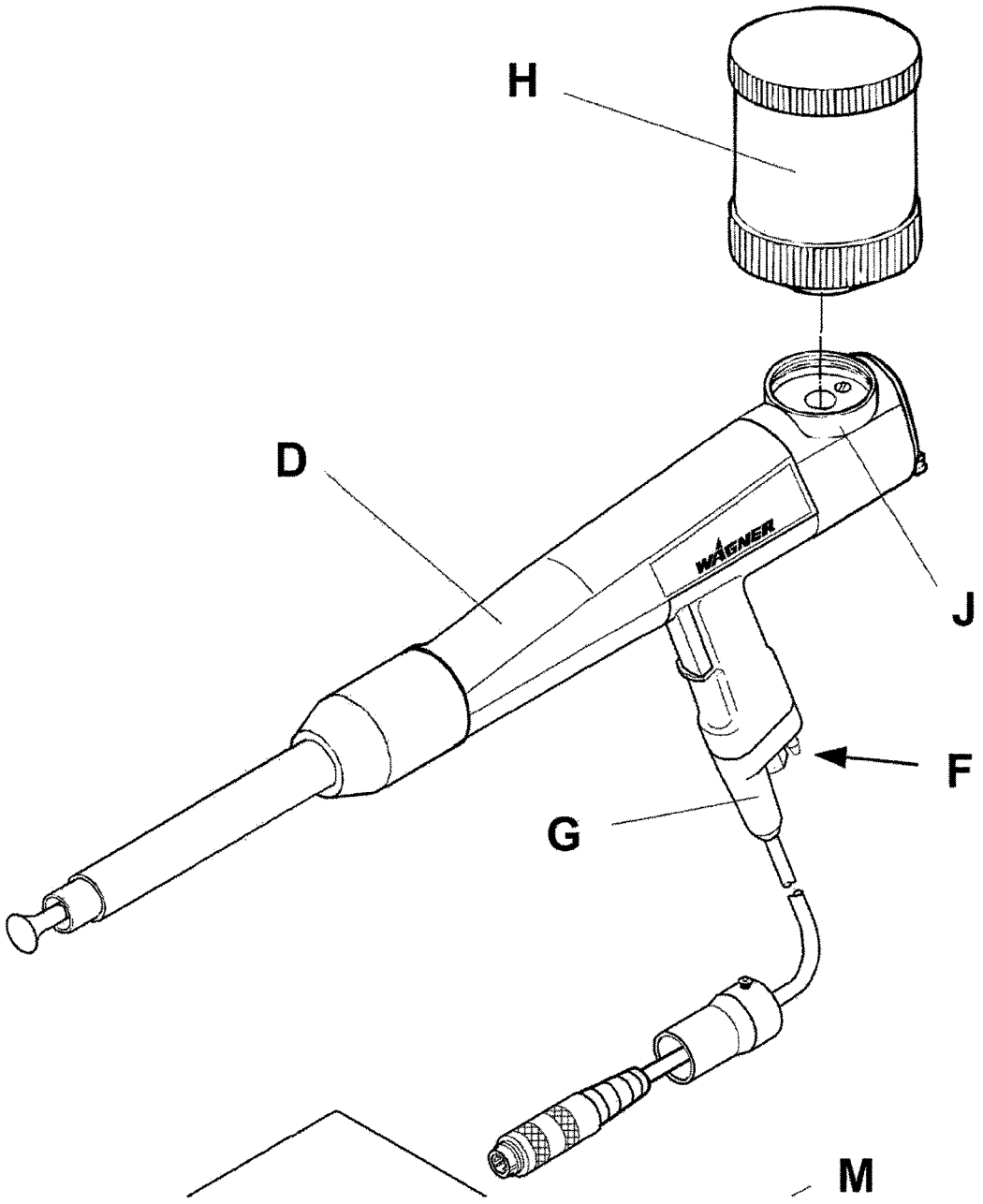
FIG. 1 shows a three-dimensional view of a powder cup spray gun according to the conventional art.
Figure 2:
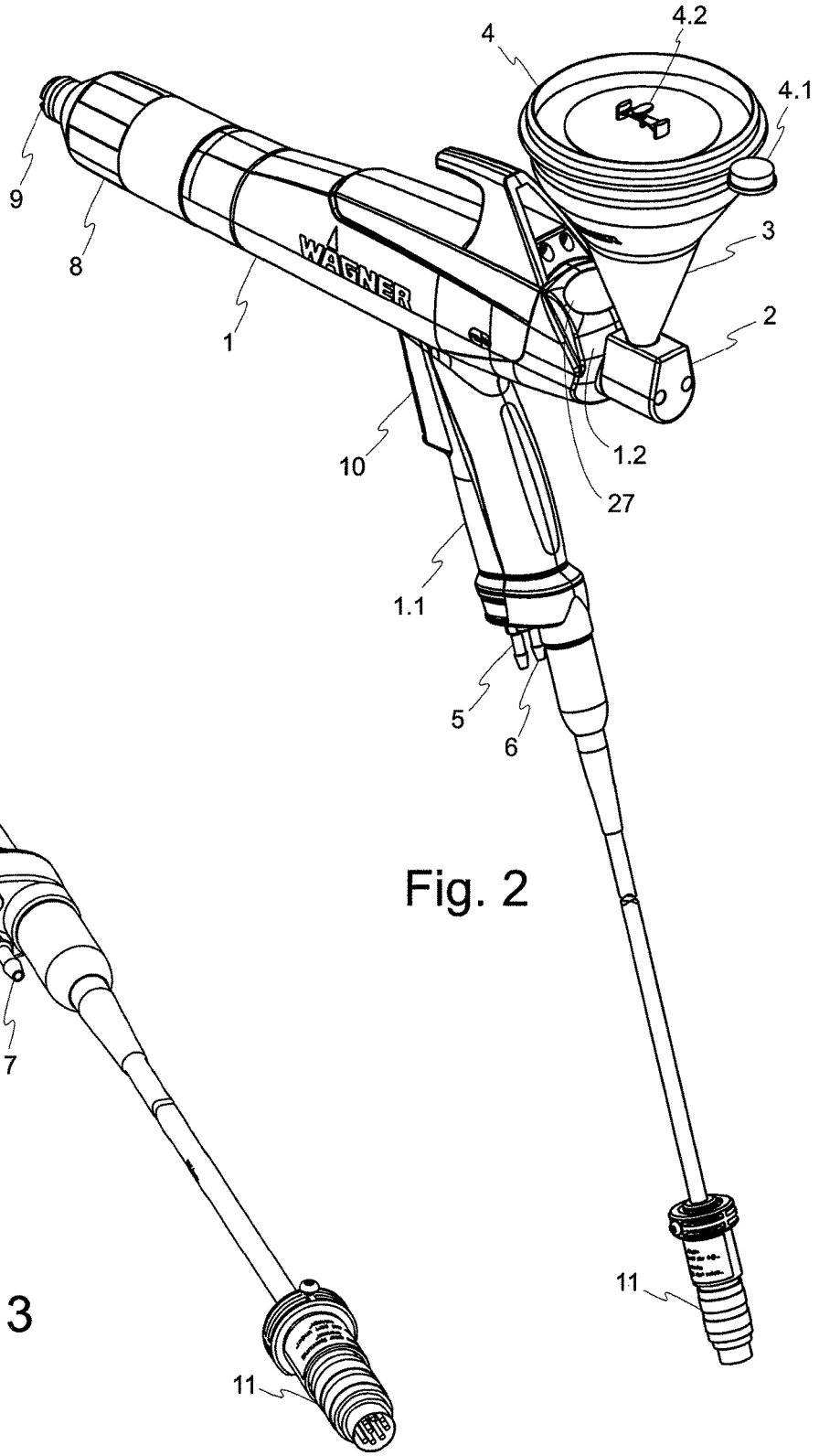
FIG. 2 shows a three-dimensional view of a possible embodiment of the cup spray gun according to the invention.

A three-dimensional view of a possible embodiment of the powder cup spray gun according to the invention is illustrated in FIG. 2. The powder cup spray gun will also be referred to hereinafter as a cup spray gun or as a spray gun for short. The cup spray gun has a housing 1. A pneumatically operated powder injector 2, which will also be referred to hereinafter as an injector for the sake of simplicity, is located at the rear end 1.2 of said housing. The cup spray gun additionally has a grip 1.1, via which the operator can hold and operate the spray gun. In the embodiment shown here, the grip 1.1 is part of the housing 1, although this does not necessarily have to be the case. The grip 1.1 can also be a separate component. The operator can control the powder flow and, as required, also the high voltage via a trigger 10, which is incorporated into the grip 1.1. If the trigger 10 is actuated, the high voltage is applied to a high-voltage electrode 12.1 (see FIG. 4). The coating powder, or powder for short, flowing past the high-voltage electrode 12.1 is electrostatically charged and is sprayed through a powder jet nozzle 9.

Figure 3:
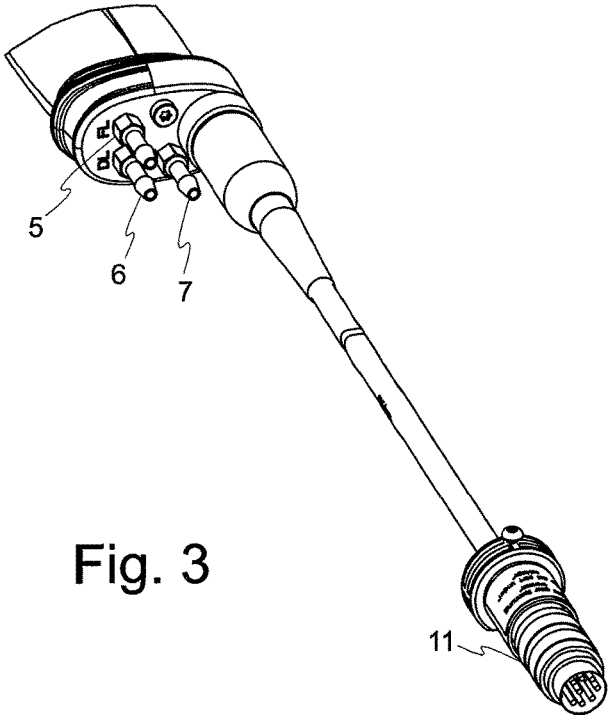
FIG. 3 shows a three-dimensional view of the lower part of the grip of the powder cup spray gun according to the invention.

A plurality of connections 5, 6, 7 and 11 is located at the lower end of the grip 10. FIG. 3 shows a three-dimensional view of this part of the grip. The injector 2 is supplied with conveying air via a connection 5 for conveying air, which will also be referred to as a conveying air connection. The injector 2 is supplied with metering air via a connection 6 for metering air, also referred to as a metering air connection. In addition, a connection 7 for atomising air, which will also be referred to as an atomising air connection, is also located at the lower end of the grip 10. The atomising air is guided in the spray gun as far as the discharge thereof. The operator can set the shape of the powder cloud with the aid of the atomising air. In addition, the atomising air can be used to cool the high-voltage cascade and to remove the ozone produced. The atomising air may also protect the electrode 12.1 against powder deposits. The atomising air additionally prevents powder from reaching the opening of the electrode holder 12, from which the electrode 12.1 protrudes. If a round jet nozzle with a baffle plate arranged in front is used instead of the flat jet nozzle shown in FIG. 2, the atomising air can also protect the baffle plate against powder deposits. Lastly, an electrical connection 11, via which a high-frequency low voltage is guided to the gun, is also located at the lower end of the grip 10. A high-voltage generator, which comprises a transformer and a downstream high-voltage cascade, is located in the spray gun and transforms the high-frequency low voltage into a high voltage. Control signals and information signals can also be guided to the spray gun from a control unit 30 shown in FIG. 5 via the electrical connection 11. In addition, control signals and information signals can also be conveyed from the spray gun to the control unit 30. As soon as the trigger 10 has been actuated, the coating powder is sprayed via the spray nozzle 9.

A control panel 27 with buttons, via which for example a formulation can be selected from a list of a plurality of formulations stored in the control apparatus 30, can be located to the rear on the spray gun. The control apparatus 30 then controls the individual parameters accordingly, such as metering air, conveying air, atomising air and voltage. The formulations or airs can however also be selected directly at the control apparatus 30. A rinse formulation for thorough cleaning of the powder ducts within the gun can also be selected.

The powder to be sprayed is located in a powder cup 3, which sits at the rear end of the spray gun in the embodiment shown in FIG. 2. The powder cup 3 has a removable lid 4 with a closable air inlet opening 4.3 (see FIG. 7). During the coating operation, the air inlet opening 4.3 is generally open, such that no partial vacuum is produced in the powder cup 3. If necessary, for example if the spray gun is not in operation or if the powder cup 3 is not fitted on the spray gun, the air inlet opening 4.3 can be closed by a closure 4.2. To this end, the nipple of the closure 4.2 is pressed into the air inlet opening 4.3. The lid 4 additionally carries a cap 4.1, which can be removed and is used so as to close the powder outlet opening 3.1 (FIG. 6) of the powder cup 3 at the bottom. If it is desired to fill the powder cup 3 with coating powder, the cap 4.1 can be removed from the lid 4 and can be used to close the powder outlet opening 3.1 at the lower end of the powder cup 3. The powder cup 3 can then be filled and, if desired, the powder cup can be closed at the top by the lid 4. It is thus ensured that the powder located in the powder cup 3 cannot escape. If it is then desired to place the powder cup 3 on the spray gun, the powder cup 3 with the powder outlet opening 3.1 is turned upwardly and the cap 4.1 is removed. The powder outlet opening 3.1 is then fitted into the receptacle 2.1 provided therefor in the injector 2. Due to the two O-rings 16 and 17 (see FIG. 9), a secure and reliably sealing connection is achieved between the receptacle 2.1 and the powder outlet opening 3.1 of the powder cup 3. The coating powder then passes through the powder outlet opening 3.1 into the directly adjoining inlet 2.2 of the injector 2. The inlet 2.2 is also referred to as a suction duct. The coating powder thus reaches the injector 2 via the shortest path from the powder cup 3 and then passes to the powder spray nozzle 9 via the powder line 15 located in the interior of the spray gun.

The injector 2 operates by the Venturi principle. Here, a partial vacuum is produced in the injector with the aid of a continuous conveying air flow and causes powder to be drawn from the powder cup 3 and transported together with the conveying air flow in the direction of the powder spray nozzle 9. Metering air is additionally fed to the injector 2 so as to assist the conveyance of the powder to the spray nozzle 9. To this end, the injector 2 comprises a driving nozzle 13 (see FIGS. 6 and 7), which can be supplied with conveying air via a compressed air line 19 (FIG. 8). The conveying air flowing from the driving nozzle 13 produces a partial vacuum in the suction duct 2.2, such that the powder is drawn from the powder cup 3. A collector nozzle 14, which discharges into the powder line 15, is located downstream after the driving nozzle 13.

A compressed air duct, which discharges into the powder line 15, is additionally located in the injector 2. The metering air can be fed into the powder line 15 via the compressed air duct. The compressed air duct advantageously discharges annularly into the powder line. The volume of metering air to be fed depends on the desired total air volume. Here, the total air volume means the sum of metering air and conveying air.

Figure 4:
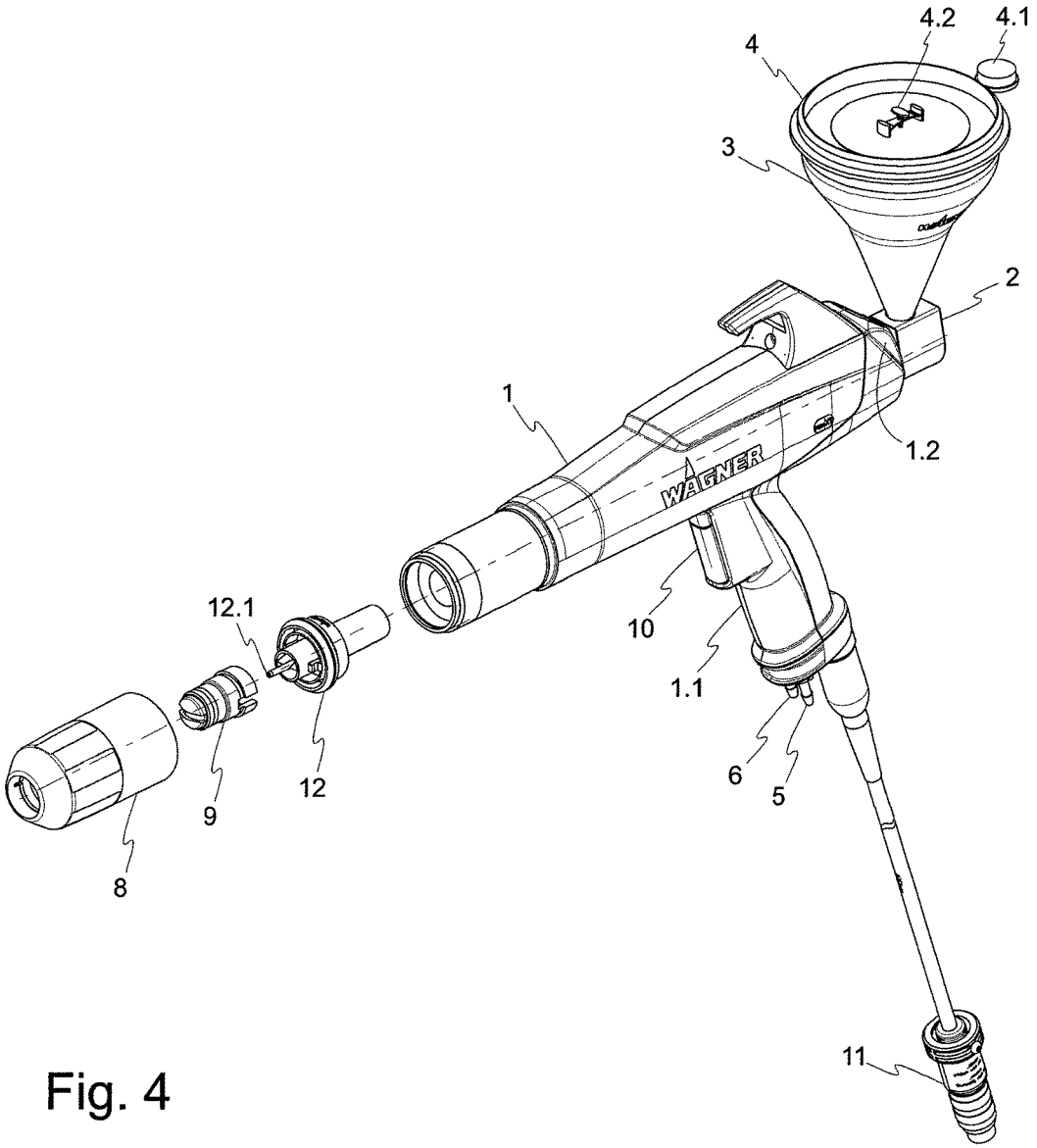
FIG. 4 shows a three-dimensional view of the powder cup spray gun according to the invention in a partly disassembled state.

FIG. 4 shows a three-dimensional view of the powder cup spray gun according to the invention in a partly disassembled state. In order to clean and service the front part of the powder cup gun, that is to say the downstream part of the powder cup gun, a cap nut 8 unscrewable by hand is first removed. The spray nozzle 9 and the electrode holder 2 with the high-voltage electrode 12.1 can then be removed.

Figure 5:
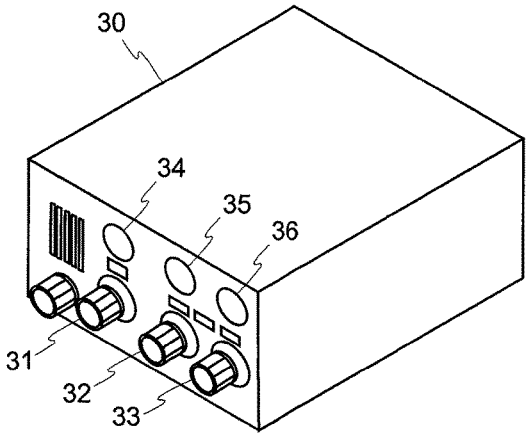
FIG. 5 shows a possible embodiment of a control apparatus for the powder cup spray gun according to the invention.

FIG. 5 shows a possible embodiment of a control apparatus 30 for the powder cup spray gun according to the invention. In this embodiment the control apparatus 30, which is also referred to as a control unit, has a first control knob 31, via which the conveying air volume per unit of time can be set. In addition, a second control knob 32 is provided, via which the metering air volume per unit of time can be set. Lastly, a third control knob 33 is provided, via which the atomising air volume per unit of time can be set. The control unit 30 comprises corresponding control circuits, which ensure that the set target values of the conveying air, metering air and atomising air are also actually observed. The actual values of the conveying air, metering air and atomising air can be read on the respective displays 34, and 36.

Figure 6:
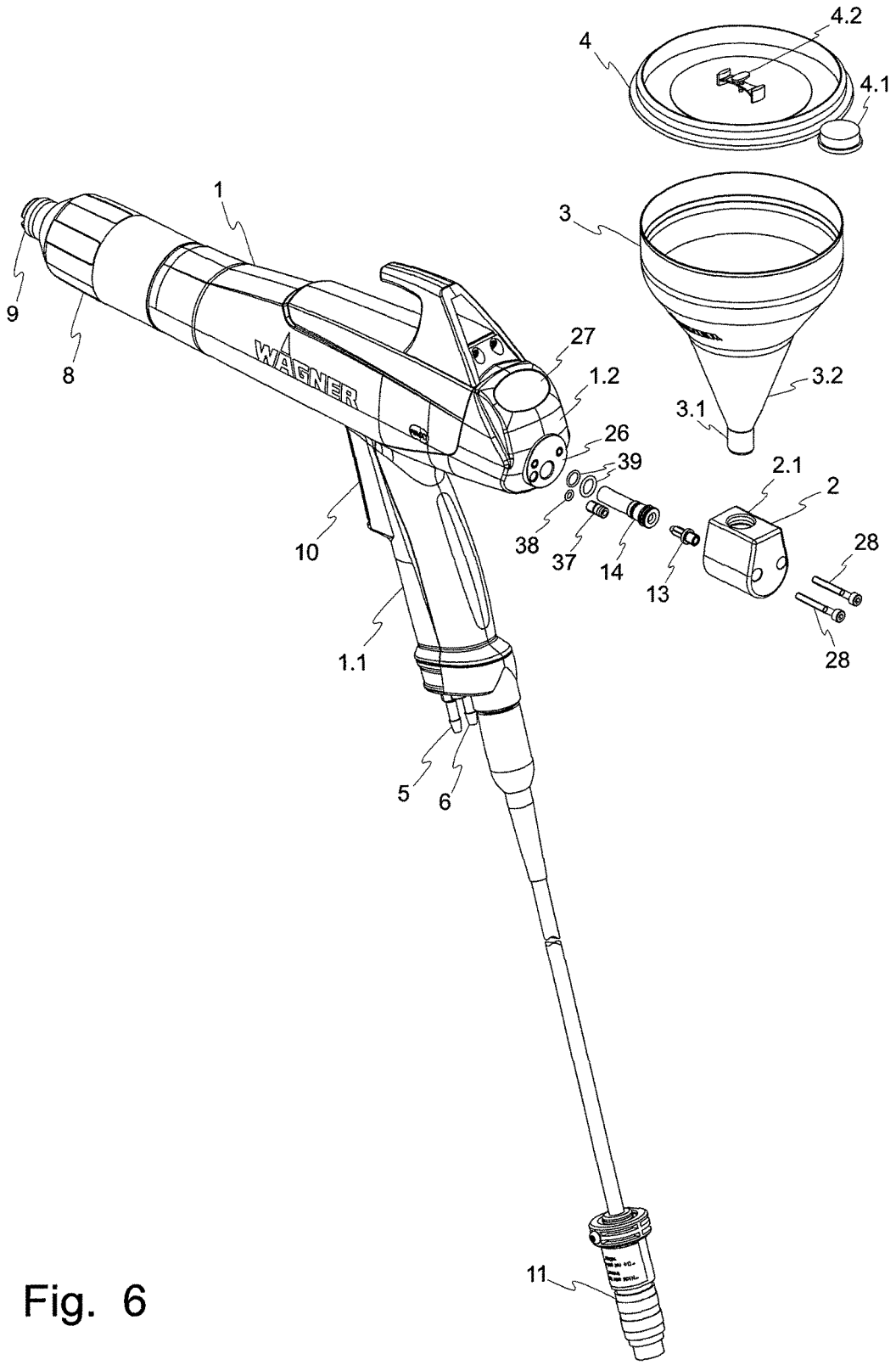
FIG. 6 shows a three-dimensional view of the powder cup spray gun according to the invention in a partly disassembled state.

FIG. 6 shows a three-dimensional view of the powder cup spray gun according to the invention in a partly disassembled state. With the aid of the two screws 28, the injector 2 can be quickly and easily released from the flange 26 in a few simple steps. The driving nozzle 13 and the collector nozzle 14 can then be removed and checked, cleaned or replaced where necessary. In addition, a short connecting tube 37 is provided, which connects the conveying air line arranged in the gun to the injector 2 and likewise can be removed. The O-rings 38 and 39 are used as seals.

Figure 7:
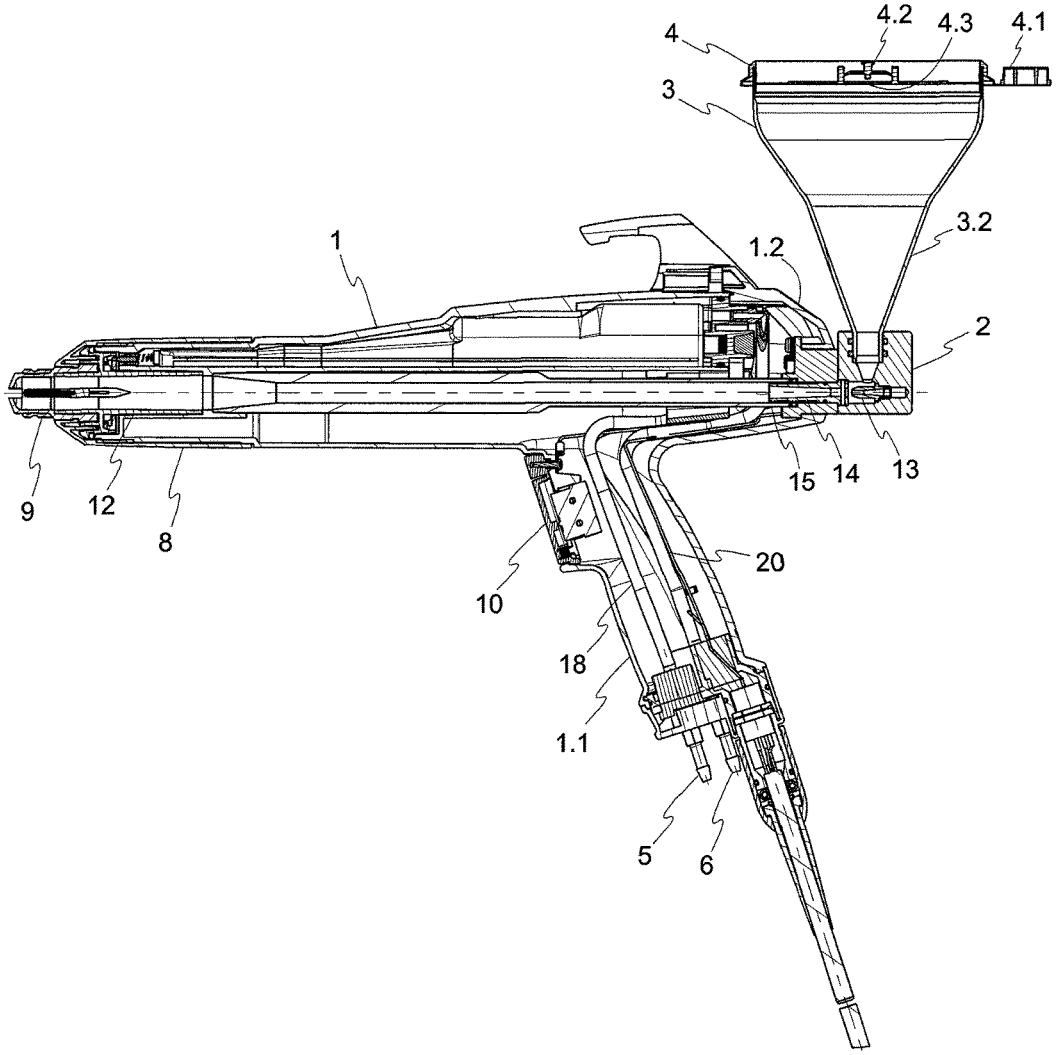
FIG. 7 shows a longitudinal sectional view of the powder cup spray gun according to the invention.
Figure 8:
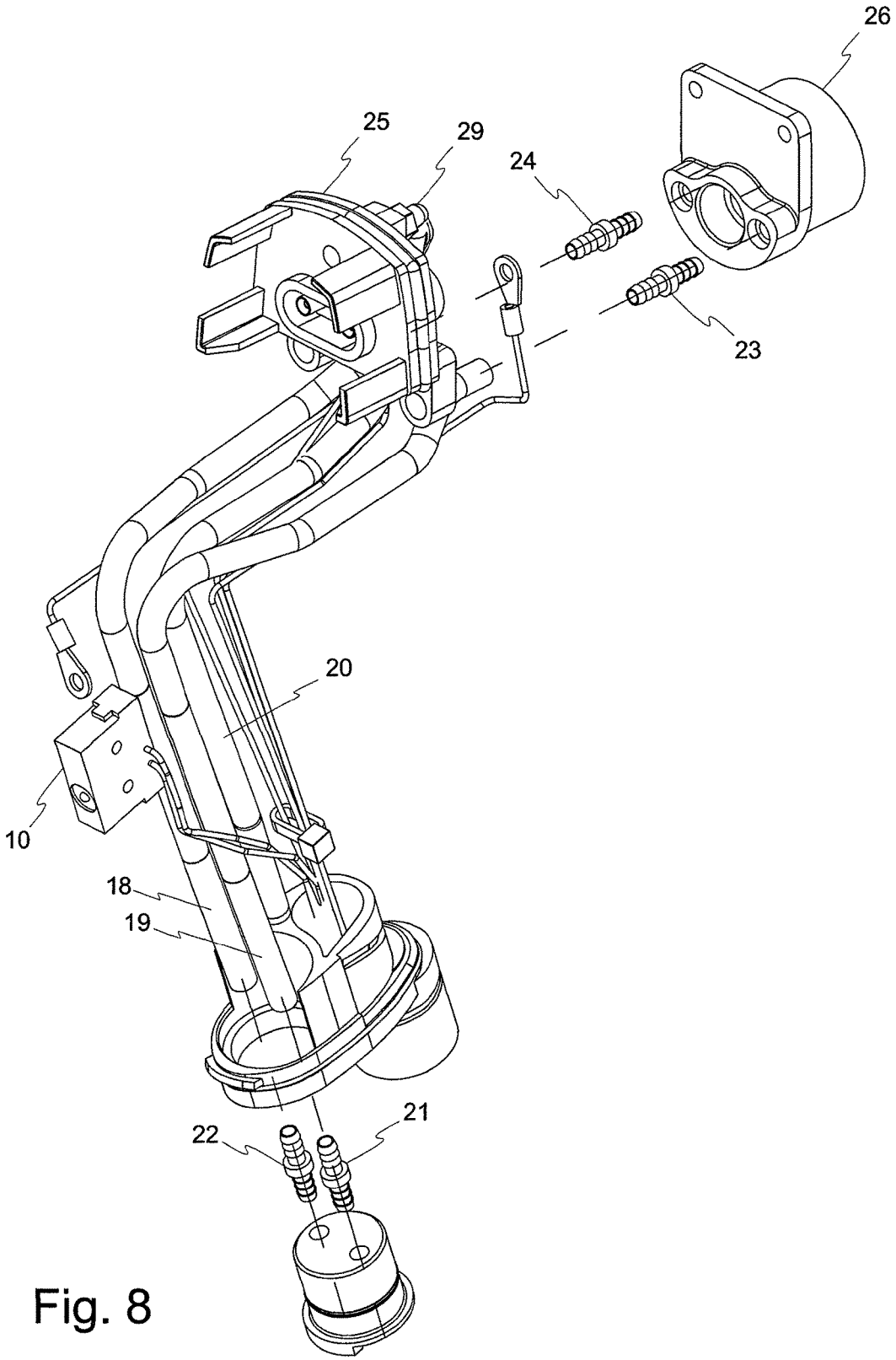
FIG. 8 shows, inter alia, the compressed air lines and connections housed in the grip of the spray gun.

FIG. 7 shows a longitudinal sectional view of the powder cup spray gun according to the invention.

FIG. 8 illustrates, inter alia, the compressed air lines and connections housed in the grip 1.1 of the spray gun.

The conveying air connection 5 is connected to one end of the compressed air line 19 via a connection nipple 21. A further connection nipple 23 connects the other end of the compressed air line 19 to a conveying air duct in the flange 26, which is in turn connected to the conveying air duct of the injector 2.

The metering air connection 6 is connected to one end of the compressed air line 18 via a connection nipple 22. A further connection nipple 24 connects the other end of the compressed air line 18 to a metering air duct in the flange 26, which is in turn connected to the metering air duct in the injector 2.

In addition, a cascade plug 25, which is connected to cables coming from the electrical connection 11, is located in the spray gun. The plug contacts of the high-voltage cascade are plugged into the cascade plug 2. The cascade plug 25 is also used to hold the compressed air line 20 (=atomising air line) at the correct position. The downstream end of the atomising air line 20 fits on a connection nipple 29. This is likewise fastened to the cascade plug 25. From here, the atomising air flows past the high-voltage cascade. It is then conveyed through the electrode holder and is guided to the discharge of the spray gun.

Figure 9:
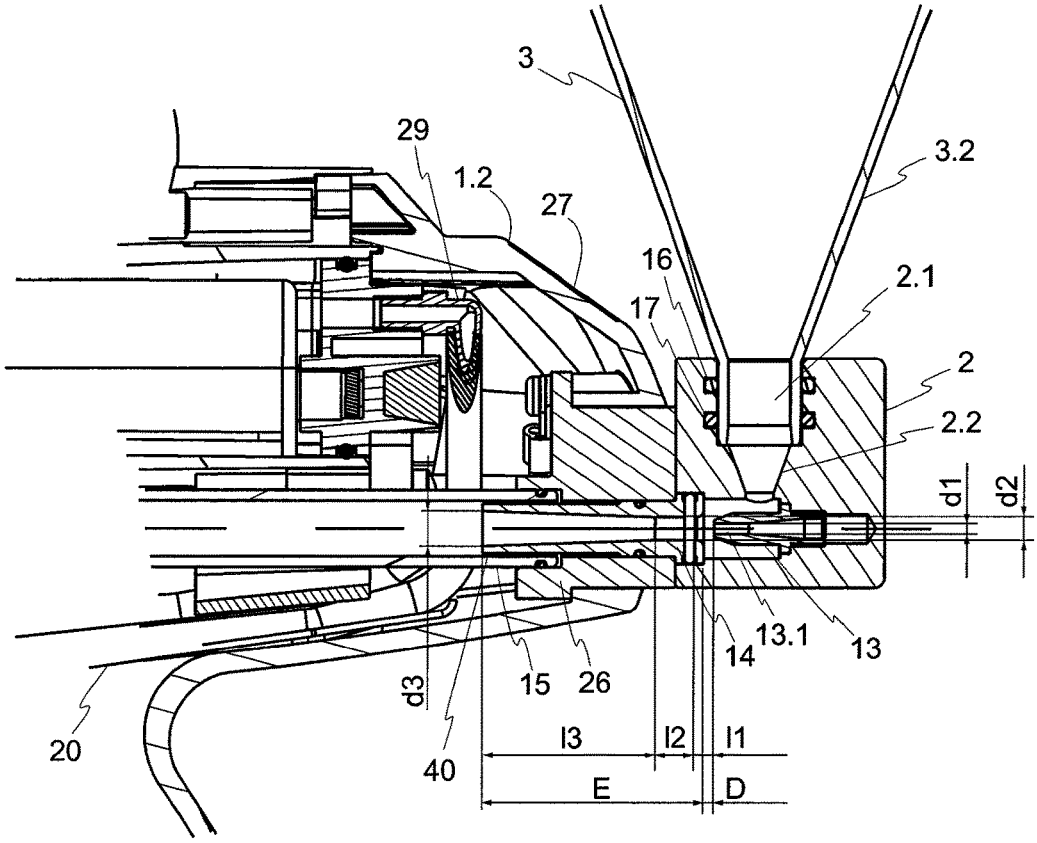
FIG. 9 shows an enlarged longitudinal sectional view of the rear part of the powder cup spray gun according to the invention.

FIG. 9 shows an enlarged longitudinal sectional view of the rear part of the powder cup spray gun according to the invention. The collector nozzle 14 has a downstream portion located downstream, after the O-ring. This downstream portion and the duct surrounding it in the flange 26 as well as the powder line 15 surrounding it form a metering air duct 40. Here, the metering air duct 40 is designed such that it discharges annularly into the powder line 15. Incidentally, the powder line 15 is also referred to as a powder tube.

The following dimensions for the injector 2 have proven to be particularly advantageous with the powder spray gun.

Diameter of the driving nozzle duct d1=1.5 mm

Diameter of the inlet discharge of the collector nozzle d2=3.3 mm.

The diameter of the inlet discharge d2 is identical to the inner diameter of the mixing tube.

Diameter of the outlet discharge of the collector nozzle d3=5.05 mm

Spacing between the driving nozzle and collector nozzle I1=2.5 mm

Spacing between the collector nozzle discharge and the start of the diffuser I2=6 mm. The spacing I2 is identical to the length of the mixing tube.

Spacing between the start of the diffuser and the end of the collector nozzle I3=25 mm Spacing between the driving nozzle and the start of the collector nozzle D=1.5 mm Spacing between the start of the collector nozzle and the end of the collector nozzle E=32 mm A ratio of the diameter d1 to d2 of $$1.9 \leq \frac{d1}{d2} \leq 2.5$$

has proven to be particularly advantageous with regard to the conveying capacity.

The above description of the exemplary embodiments according to the present invention is used merely for illustrative purposes and is not used for the purpose of limiting the invention. Various changes and modifications are possible within the scope of the invention without departing from the scope of the invention and equivalents thereof. For example, not all components shown in FIGS. 2 to 9 are therefore necessary in order to produce the powder cup spray gun.

In an alternative embodiment, the powder cup 3 has a radially protruding lug in the region of the tube portion 3.1, and the receptacle 2.1 has one or more radial convexities. The convexities are used to receive the lug. The lug and convexities form a type of bayonet closure. Once the powder cup 3 has been fitted into the receptacle 2.1, it is rotated through a specific angle. The powder cup 3 is thus fixed even more securely on the spray gun.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

LIST OF REFERENCE SIGNS

1 gun housing
1.1 grip
1.2 rear end of the powder cup gun
2 injector
2.1 receptacle
2.2 powder inlet
3 powder cup
3.1 tube portion
3.2 cup wall
4 lid
4.1 cap
4.2 closure
4.3 air inlet opening
5 connection for conveying air
6 connection for metering air
7 connection for atomising air
8 cap nut
9 powder jet nozzle
10 trigger
11 electrical connection
12 electrode holder
12.1 electrode
13 driving nozzle
13.1 driving nozzle duct
14 collector nozzle
15 powder tube
16 O-ring
17 O-ring
18 air line for metering air
19 air line for conveying air
20 air line for atomising air
21 tube nipple
22 tube nipple
23 tube nipple
24 tube nipple
25 cascade plug
26 flange
27 control panel
28 screw
29 connection nipple for the atomising air
30 control unit
31 control knob
32 control knob
33 control knob
34 display
35 display
36 display
37 connecting tube
38 O-ring
39 O-ring
40 metering air duct

The invention claimed is:

1. A powder cup spray gun, comprising:
a housing at a rear end of which an injector with a powder inlet is included,
a grip for the housing, the grip including a trigger for activating the spray gun, and
a funnel-shaped powder cup and a receptacle for the powder cup,
wherein the powder inlet of the injector is connected to the receptacle,
wherein the powder cup and the receptacle have a fitted connection therebetween so that the powder cup can be slidably engaged with the receptacle,
wherein the grip for the housing is included with a connection for conveying air, a connection for atomising air and a connection for metering air that are each arranged outside a body of the grip and extending from a lower end of the grip,
wherein the grip houses a plurality of compressed air lines, and each of the connection for the conveying air and the connection for the metering air are connected to the injector via the compressed air lines housed in the grip and running from the lower end of the grip to the injector.

2. The powder cup spray gun according to claim 1,
wherein the housing is configured so that the injector can be unscrewed from the outside.

3. The powder cup spray gun according to claim 1,
further comprising a ring seal in the receptacle for the powder cup.

4. The powder cup spray gun according to claim 3,
further comprising a further ring seal provided in the receptacle for the powder cup.

5. The powder cup spray gun according to claim 1, further comprising:
a powder line, and
a metering air duct, which discharges annularly into the powder line.

6. The powder cup spray gun according to claim 1,
wherein the injector includes a driving nozzle and a collector nozzle,
wherein the driving nozzle has a driving nozzle duct, and the collector nozzle has a mixing tube portion, and
wherein the ratio between the diameter of the driving nozzle duct dl and the inner diameter of the mixing tube portion d2 is in the range between 1.9 and 2.5.

7. A powder cup for a powder cup gun according to claim 1, wherein a side wall of the powder cup is funnel-shaped.

8. The powder cup according to claim 7, wherein a powder outlet is included which is tubular.

9. The powder cup according to claim 7, further comprising:

a lid with a separable cap, wherein the cap is configured so that it is suitable for closing the powder outlet.

10. A spray-coating device comprising a powder cup gun according to claim 1, including a control unit configured to control the conveying air, the atomising air and the metering air, compressed air tubes which connect the control unit to the connection for the conveying air, to the connection for the metering air, and to the connection for the atomising air of the powder cup gun.

* * * * *